US007263325B2

(12) United States Patent
Marin et al.

(10) Patent No.: US 7,263,325 B2
(45) Date of Patent: Aug. 28, 2007

(54) AUGER FOR USE IN AN IMAGE FORMING DEVICE

(75) Inventors: Claudia A. Marin, Lexington, KY (US); John W. Kietzman, Lexington, KY (US); Tom E. Stickler, Lexington, KY (US); Michael L. Pawley, Nicholasville, KY (US)

(73) Assignee: Lexmark International, Inc., Lexington, KY (US)

( * ) Notice: Subject to any disclaimer, the term of this patent is extended or adjusted under 35 U.S.C. 154(b) by 249 days.

(21) Appl. No.: 10/957,853

(22) Filed: Oct. 4, 2004

(65) Prior Publication Data

US 2006/0072947 A1 Apr. 6, 2006

(51) Int. Cl.
*G03G 15/00* (2006.01)

(52) U.S. Cl. ..... 399/358; 399/252; 399/256

(58) Field of Classification Search ..... 399/252, 399/253, 254, 256, 343, 358, 359, 360, 255, 399/262, 263

See application file for complete search history.

(56) References Cited

U.S. PATENT DOCUMENTS

| | | | | |
|---|---|---|---|---|
| 4,739,907 | A | 4/1988 | Gallant | |
| 4,943,830 | A | 7/1990 | Sulenski | |
| 5,187,524 | A | 2/1993 | Cherian | |
| 5,202,728 | A * | 4/1993 | Maeshima et al. | 399/114 |
| 5,257,077 | A | 10/1993 | Peters, Jr. et al. | |
| 5,264,900 | A | 11/1993 | Momiyama et al. | |
| 5,575,408 | A * | 11/1996 | Marqueling et al. | 222/412 |
| 5,638,160 | A | 6/1997 | Vollenbrock | |
| 5,708,952 | A | 1/1998 | Taniguchi et al. | |
| 5,729,804 | A * | 3/1998 | Aruga et al. | 399/263 |
| 5,742,882 | A | 4/1998 | Lee | |
| 5,881,345 | A * | 3/1999 | Yamane et al. | 399/255 |
| 5,953,567 | A * | 9/1999 | Muramatsu et al. | 399/256 |
| 6,014,541 | A | 1/2000 | Kato et al. | |
| 6,196,958 | B1 * | 3/2001 | Shiraki et al. | 492/59 |
| 6,259,876 | B1 * | 7/2001 | Fukuda et al. | 399/254 |
| 6,510,304 | B2 | 1/2003 | Abramsohn | |
| 6,546,225 | B2 | 4/2003 | Wang | |
| 6,711,374 | B2 * | 3/2004 | Funayama et al. | 399/359 |
| 2002/0154914 | A1 * | 10/2002 | Funayama et al. | 396/564 |
| 2003/0156859 | A1 | 8/2003 | Tamai | |
| 2005/0281588 | A1 * | 12/2005 | Okuda et al. | 399/254 |
| 2006/0188273 | A1 * | 8/2006 | Takesawa et al. | 399/27 |

FOREIGN PATENT DOCUMENTS

| | | |
|---|---|---|
| JP | 58-144473 | * 11/1981 |
| JP | 2002-284594 | * 10/2000 |
| JP | 2001-83802 | * 3/2001 |

* cited by examiner

*Primary Examiner*—Hoan Tran
(74) *Attorney, Agent, or Firm*—Coats & Bennett, PLLC

(57) ABSTRACT

A helical auger member for transporting toner in an image forming apparatus. The auger member may be implemented as part of a waste toner removal system for removing toner from a photoconductive member of a toner cartridge. Toner that is removed by a cleaner member is transported through a cleaner housing with a helical member, such as a coil wire, having a pitch to outer diameter ratio from about 1.5 to 2.5.

18 Claims, 8 Drawing Sheets

AUGER FOR USE IN AN IMAGE FORMING DEVICE

BACKGROUND

During the image forming process, toner is transferred from toner carrying members to print or copy media. Inefficiencies in the transfer process cause residual toner to remain on the toner carrying members or other transport members, such as transport belts, intermediate transfer belts/drums, and photoconductive members. Residual toner may also be created during registration, color calibration, paper jams, and over-print situations. This residual toner should be cleaned before it affects the quality of subsequent images. The residual or waste toner is commonly removed by a blade or other means and the removed toner is stored in a waste toner container.

Space constraints often require that a waste toner container in an electrophotographic device be located at some remote location away from the cleaning location. Because of this separation, waste toner is conveyed from the cleaning location to the waste container. The conveyance path between the cleaner location and the waste toner container is also limited by space and often travels through the internals of the electrophotographic device. Consequently, the conveyance mechanism that transports waste toner from the cleaner location to the waste toner should be designed to fit in confined spaces. On the other hand, the conveyance mechanism should be designed to transport a sufficient volume of waste toner to keep the cleaner location free of accumulated waste toner. If waste toner is not transported away from the cleaner location efficiently enough, toner may begin to accumulate and degrade the cleaning operation, resulting in poor image quality.

SUMMARY

The present invention is directed to a toner auger for use in transporting toner in an image forming apparatus. The auger is a helical member having a pitch that is some optimum multiple of the outer diameter of the auger. In one embodiment, the helical member is a coil wire with a circular cross section. In another embodiment, the helical member is a screw-type auger. In either case, the helical member may be constructed with a pitch to outer diameter ratio in the range of about 1.5 to 2.5. Peak toner throughput efficiency may be achieved by selecting a pitch to outer diameter ratio of about 1.7. The optimal pitch to outer diameter ratio may provide more noticeable toner throughput efficiency improvements where cleaned waste toner is transported. In an exemplary embodiment, an auger of approximately 5.5 to 7 millimeters outer diameter is selected. The corresponding pitch may be selected to be in the range of about 10 and 11 millimeters.

DETAILED DESCRIPTION

Figure 1:
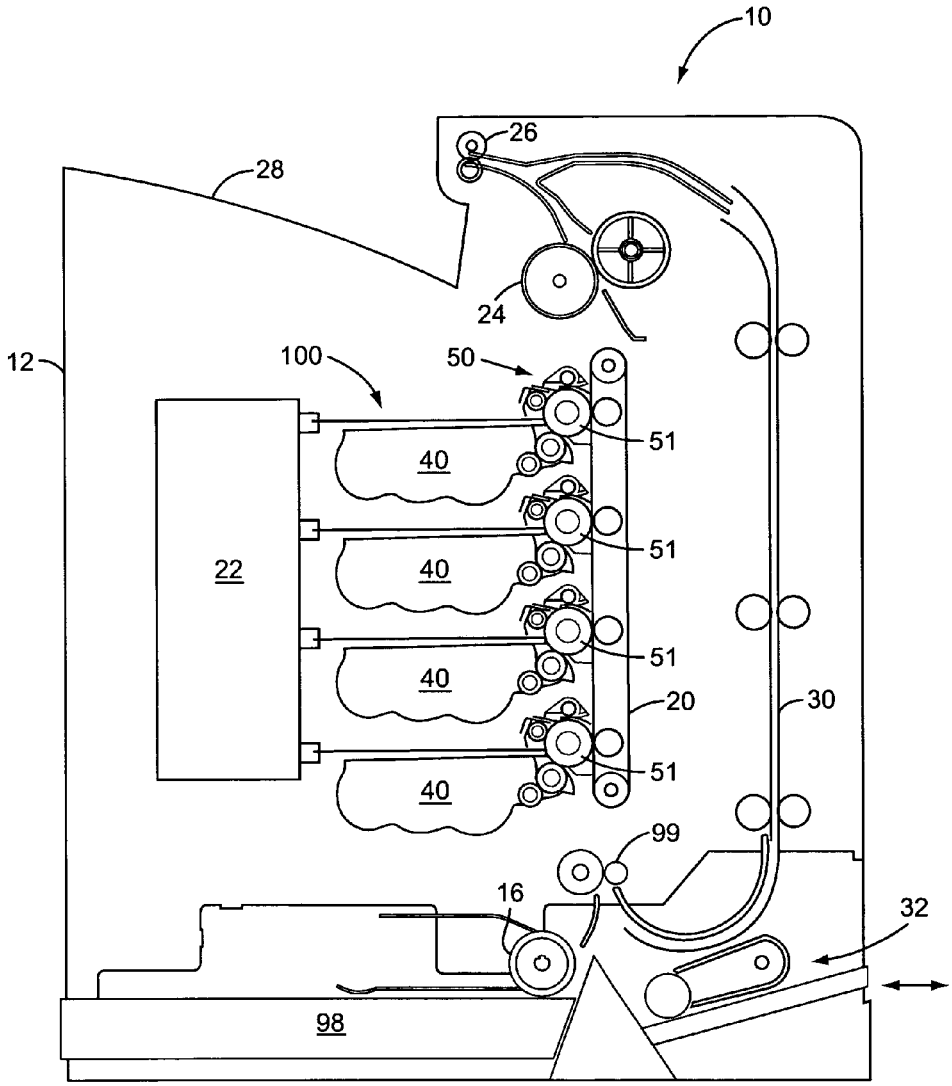
FIG. 1 is a schematic view of an image forming device according to one embodiment of the present invention.

The present invention is directed to a toner auger for use within an image forming device 10, such as a printer, as generally illustrated in FIG. 1. The representative image forming device, indicated generally by the numeral 10, comprises a main body 12. A media tray 98 with a pick mechanism 16, or a multi-purpose feeder 32, are conduits for introducing media sheets into the device 10. The media tray 98 is preferably removable for refilling, and located on a lower section of the main body 12.

Media sheets are moved from the input and fed into a primary media path. One or more registration rollers 99 disposed along the media path aligns the print media and precisely controls its further movement along the media path. A media transport belt 20 forms a section of the media path for moving the media sheets past a plurality of image forming units 100. Color printers typically include four image forming units 100 for printing with cyan, magenta, yellow, and black toner to produce a four-color image on the media sheet.

An imaging device 22 forms an electrical charge on a photoconductive member 51 within the image forming units 100. The media sheet with loose toner is then moved through a fuser 24 that adheres the toner to the media sheet. The sheet is then either forwarded through the output rollers 26 into an output tray 28, or the rollers 26 rotate in a reverse direction to move the media sheet to a duplex path 30. The duplex path 30 directs the inverted media sheet back through the image formation process for forming an image on a second side of the media sheet.

Figure 2:
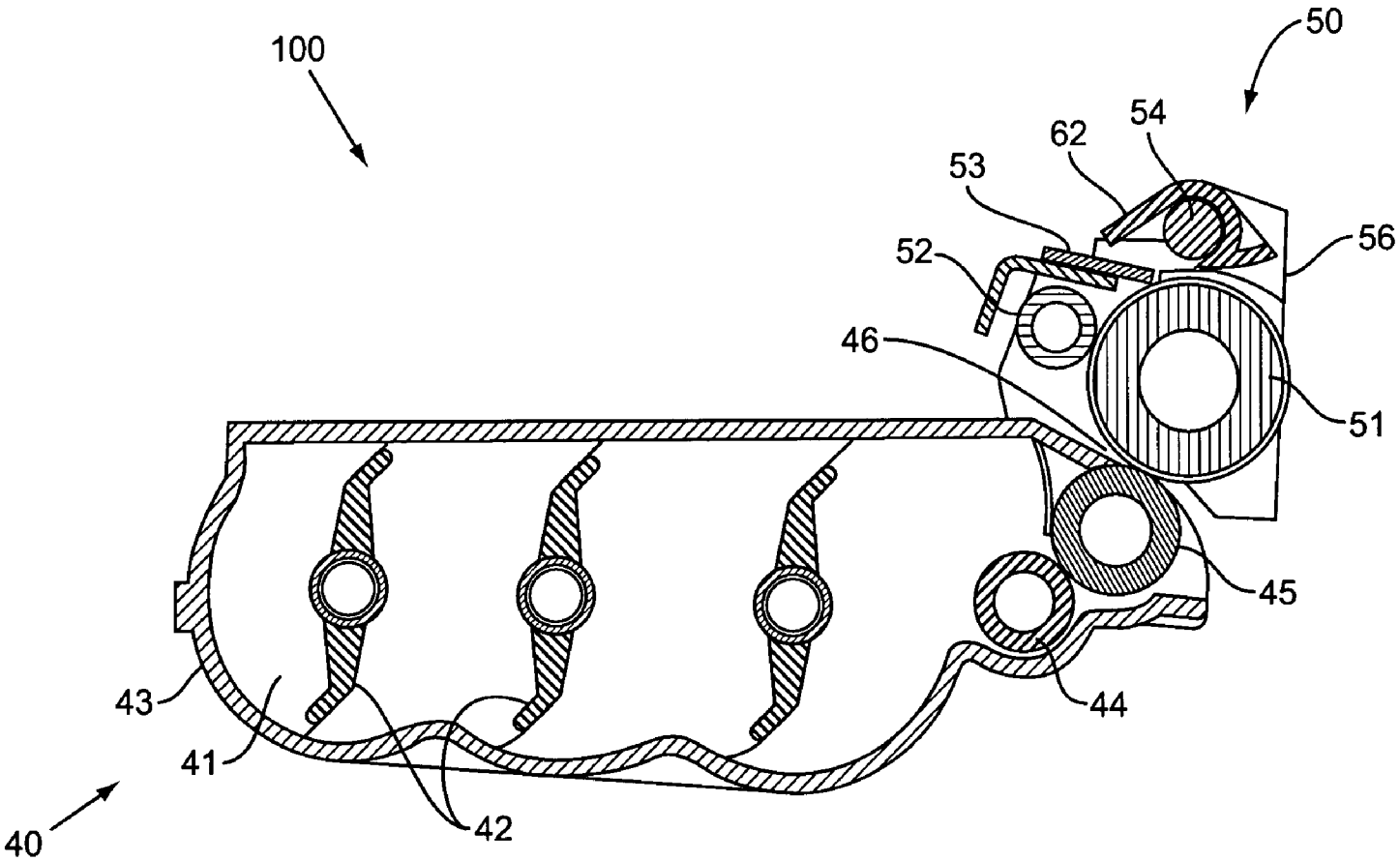
FIG. 2 is a cross-sectional view of an image forming unit according to one embodiment of the present invention.

As illustrated in FIGS. 1 and 2, the image forming units 100 are constructed of a developer unit 40 and a photoconductor unit 50. The developer unit 40, including a developer member 45, is positioned within the main body 12. The photoconductor unit 50, including a photoconductive member 51, is also mounted within the main body 12, but is independent of the developer unit 40.

FIG. 2 illustrates a cross-sectional view of the image forming unit 100 in the operating orientation. The developer unit 40 comprises an exterior housing 43 that forms a reservoir 41 for holding a supply of undeveloped toner. One or more agitating members 42 are positioned within the reservoir 41 for agitating and moving the toner towards a toner adder roll 44 and the developer member 45. Toner moves from the reservoir 41 via the one or more agitating members 42, to the toner adder roll 44, and finally is distributed to the developer member 45. The developer unit 40 is structured with the developer member 45 on an exterior section where it is accessible for contact with the photoconductive member 51.

Figure 3:
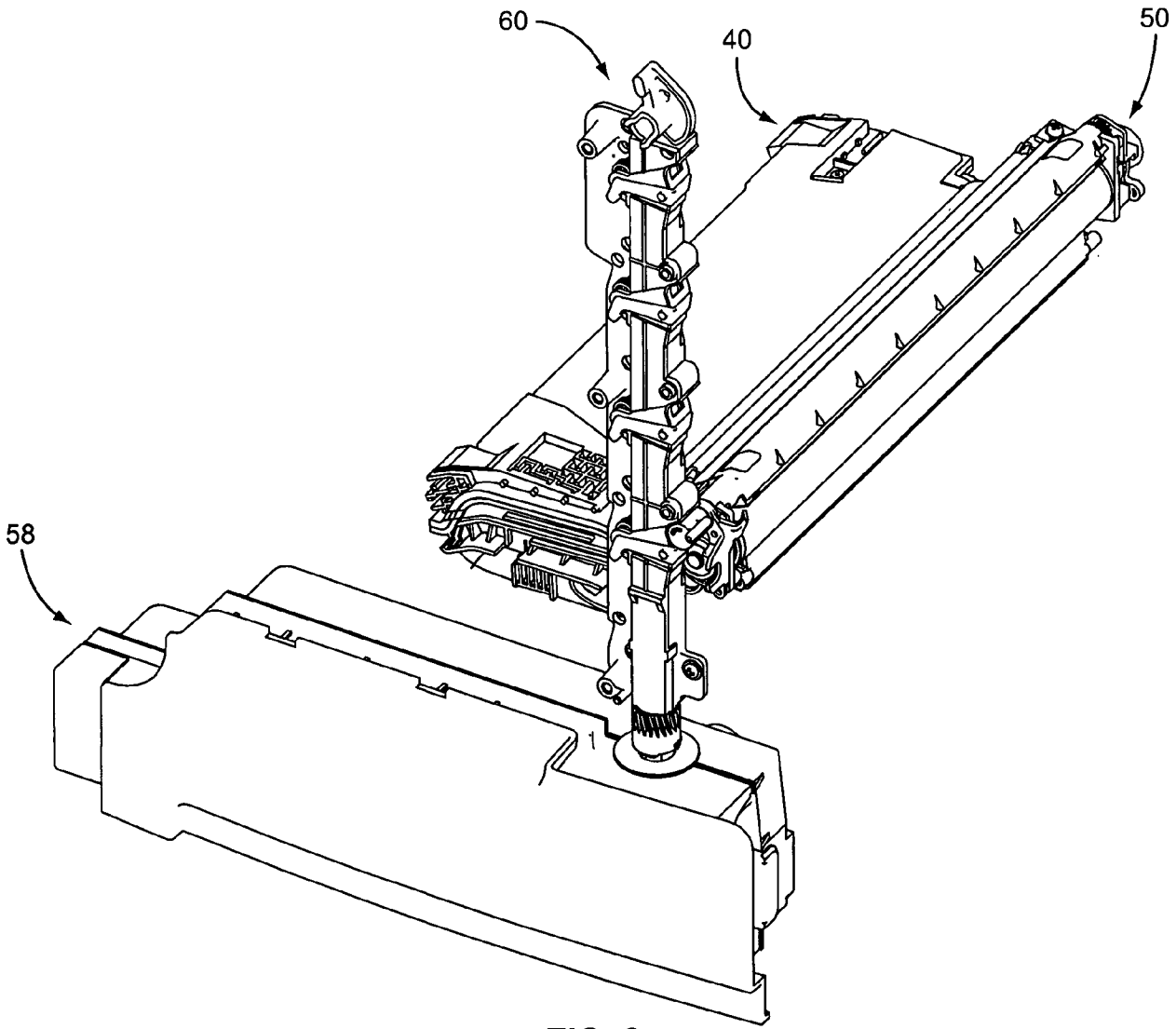
FIG. 3 is a perspective assembly view showing the components in the toner transport path of an image forming device according to one embodiment of the present invention.

The photoconductor unit 50 comprises the photoconductive member 51, and a charge roller 52. In one embodiment, the photoconductive member 51 is an aluminum hollow-core drum coated with one or more layers of light-sensitive organic photoconductive materials. A housing 56 forms the exterior of a portion of the photoconductor unit 50. The photoconductive member 51 is mounted protruding from the photoconductor unit 50 to contact the developer member 45. Charge roller 52 applies an electrical charge to the photoconductive member 51 to receive an electrostatic latent image from the imaging device 22 (FIG. 1). A cleaner blade 53 contacts the surface of the photoconductive member 51 to remove toner that remains on the photoconductive member 51 following transfer of the developed image to a media sheet passing between the photoconductive member 51 and the media transport belt 20 (FIG. 1). The residual toner is moved to a cleaner housing 62. A waste toner auger 54 within the cleaner housing 62 moves the waste toner out of the photoconductor unit 50 and towards a waste toner container 58 as shown in FIG. 3. The waste toner is stored in the waste toner container 58, which may be disposed of once full.

FIG. 3 shows the arrangement of the toner-bearing components of the representative image forming apparatus 10. The housing 12, media transport components, and image forming components are removed from FIG. 3 for clarity. Further, FIG. 3 shows only one of the four image forming units 100 typically found in a color image forming apparatus 10. Thus, FIG. 3 represents the toner flow path for a single color, beginning in the developer unit reservoir 41 and ending in the waste toner reservoir 58. Following the image forming process described above, residual waste toner is removed from the photoconductor unit 50 by a waste toner auger 54 (FIG. 2) and transported to a vertical waste chute 60. The waste toner within the vertical chute 60 falls under the influence of gravity into waste toner reservoir 58. Additionally, the vertical chute 60 may have a separate auger (not shown) to direct the waste toner into the waste toner reservoir 58. As seen in FIG. 3, the photoconductor unit 50 is oriented in a generally horizontal position. Thus, the auger 54 included within the photoconductor 50 may not be aided by gravity in removing residual waste toner. The task of removing waste toner from the photoconductor unit 50 is incumbent upon the waste toner auger 54. Unless the waste toner auger 54 effectively removes the residual waste toner from the photoconductor unit 50, the waste toner will accumulate and impart back-pressure on the cleaner blade 53. With such back-pressure, the cleaner blade 53 may not effectively remove residual toner from the photoconductive drum 51, resulting in degraded image quality. The waste toner auger 54 is therefore configured to optimally transfer waste toner away from the photoconductor unit 51.

Figure 4:
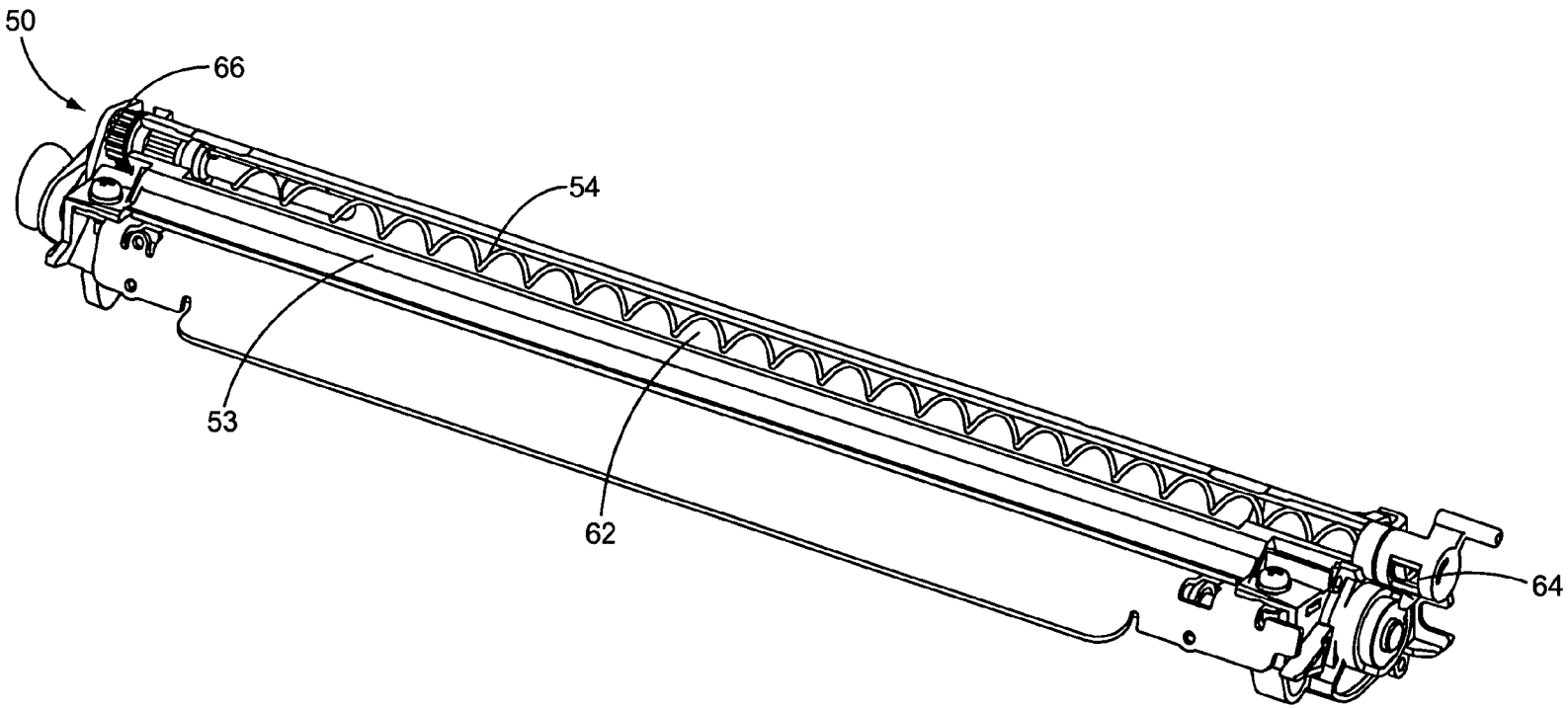
FIG. 4 is a perspective assembly view showing a photoconductor unit according to one embodiment of the present invention.
Figure 5:
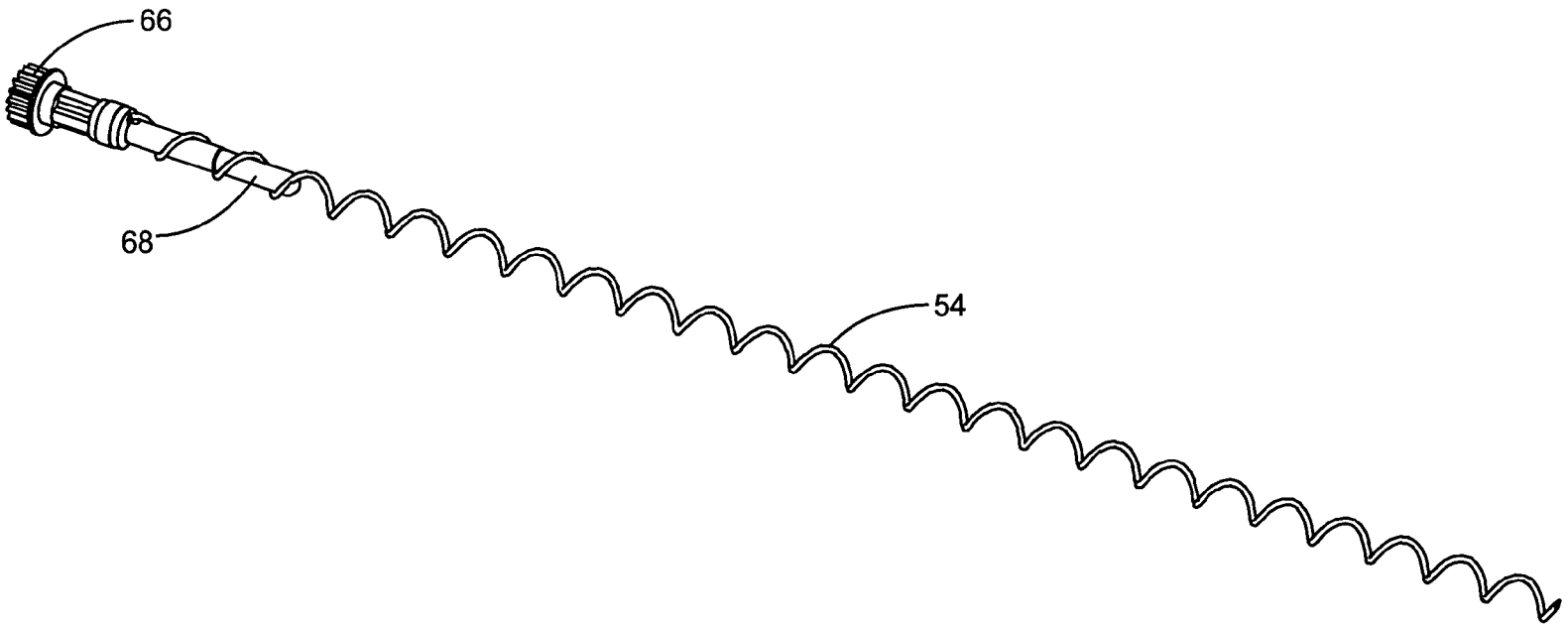
FIG. 5 is a perspective assembly view of a waste toner auger and drive gear according to one embodiment of the present invention.

FIG. 4 shows a perspective view of the photoconductor unit 50 oriented to observe the included waste toner auger 54. Also visible in FIG. 4 is the cleaner blade 53, which removes residual toner from the photoconductive drum 51 (not seen in FIG. 4) and deposits the residual toner into the inner channel of cleaner housing 62. The waste toner auger 54 rotates to remove the waste toner towards exit 64 where the waste toner is transferred into the vertical chute 60 shown in FIG. 3. The waste toner auger 54 is rotated by a drive gear 66 that is itself driven by a drive motor and drive train (not shown). As seen in FIG. 5, the waste toner auger 54 may be implemented as a wire auger that engages with and is driven by a stub 68 integral with the gear 66. In one embodiment, the end of the waste toner auger 54 opposite to the drive gear 66 and drive stub 68 is unattached and cantilevered. The waste toner auger 54 rotates within the inner channel of cleaner housing 62. In one embodiment, the inner channel has a substantially circular cross section with about a 6.7 mm diameter.

Figure 6:
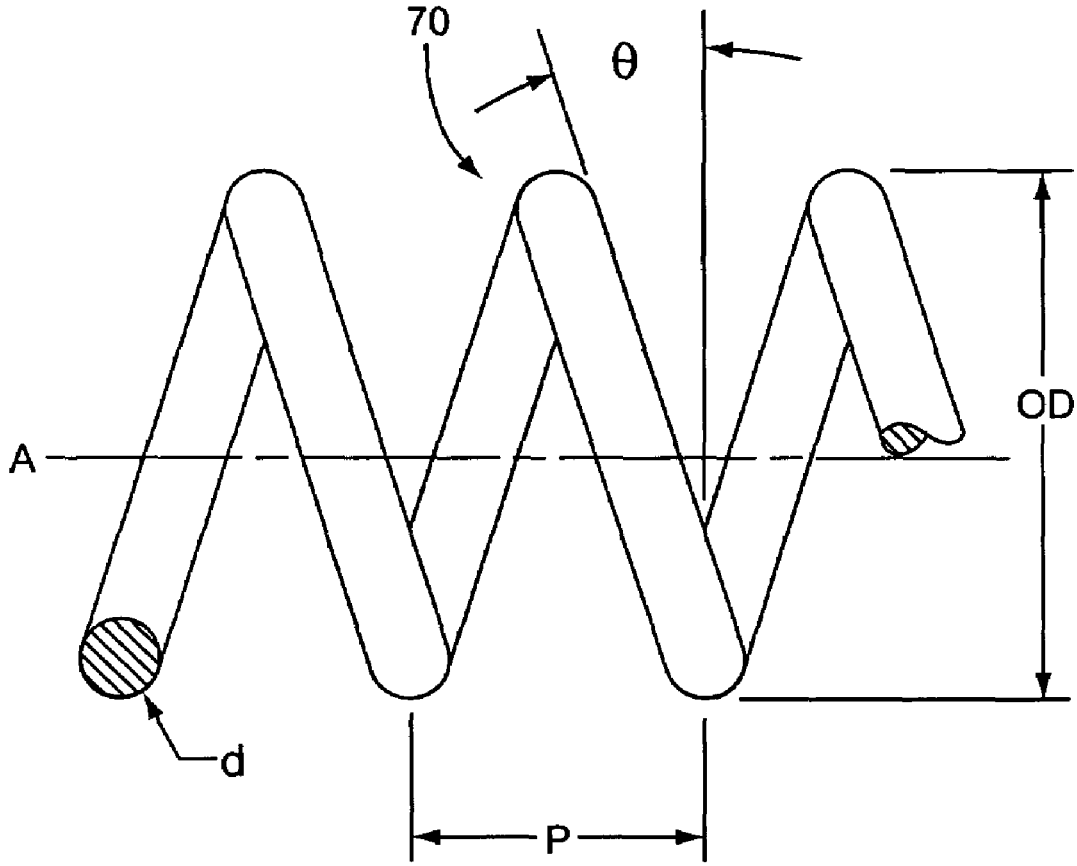
FIG. 6 is a partial side view of a helical coil wire adaptable for use as a toner auger according to one embodiment of the present invention.

Wire augers of various shapes and sizes may be used to transport toner within an image forming apparatus. As FIG. 6 shows, a helical coil 70 of the type used for the waste toner auger 54 is characterized by several key dimensions, including outer diameter OD, wire diameter d, and pitch P. The term pitch is known to those skilled in the art to mean the distance from any point on an individual coil to the corresponding point on an adjacent coil measured parallel to the axis A. The same term is applicable for helical screw type augers where the measurement is taken between corresponding points on adjacent locations of an individual blade (see FIG. 10).

A coil 70 such as the one in FIG. 6 may also be described by a helix angle θ, that represents the tilt angle for the individual coils relative to a direction perpendicular to the axis of rotation A. The helix angle θ is determinable from the pitch P and outer diameter OD according to the following equation:

$$\theta = \arctan\left(\frac{P/2}{OD}\right)$$

The coil 70 shown in FIG. 6 has a circular cross section of diameter d. Coils may also be constructed with other cross sections, including square, flat, tapered, and other shapes known to those skilled in the art. However, circular cross sections are the most common and experimentation has shown that the various cross sections did not produce significantly different throughputs. That is, the mass flow rate of toner that was moved by augers having the different cross sections did not vary significantly. In one embodiment, and in the experiments disclosed herein, a circular cross section is used and the wire diameter d of the coil 70 is selected to be about 1 mm.

Optimization experiments were performed to determine the effects of pitch variation on throughput for wire augers made from a helical coil 70. For the experimentation, wire augers having a common wire diameter d and common outer diameter OD, but varying pitches P were analyzed to determine throughput. Each auger was rotated to transport toner within a volume similar to the inner channel of cleaner housing 62 shown in FIGS. 2 and 4. The wire augers were rotated at a set rotational velocity of about 90 revolutions per minute. The outer diameter OD of the wire augers was held at a constant value. Specifically, in the experiments disclosed herein, a suitable value of about 6 mm was chosen for the outer diameter.

Various toner types were also considered in the experiments. The toners used in the experiments disclosed herein were milled toners, generally similar to that used in the Lexmark C750 family of printers available from Lexmark International, Inc. The present invention is also intended for use with toners that are chemically produced, rather than milled. These chemically produced toners can be made via processes known by those skilled in the art, including but not limited to emulsion aggregation or polymerization in place. Chemically produced toner particles are typically more nearly spherical than particles of milled toner.

Toner may vary not only by chemical composition, but also by a pre-development and post-development distinction. Toner that has not yet been developed (undeveloped toner) may be classified as fresh or worked. Fresh toner, as the name implies, is toner that has not been subjected to an excessive amount of mechanical degradation often caused by agitation within a toner supply reservoir 41. Toner that has been subjected to this type of degradation is often classified as worked toner. After toner is used to develop a latent image on a photoconductive member 51, the residual waste toner removed by a cleaner blade 53 is commonly referred to as cleaned toner.

Experiment 1

Figure 7:
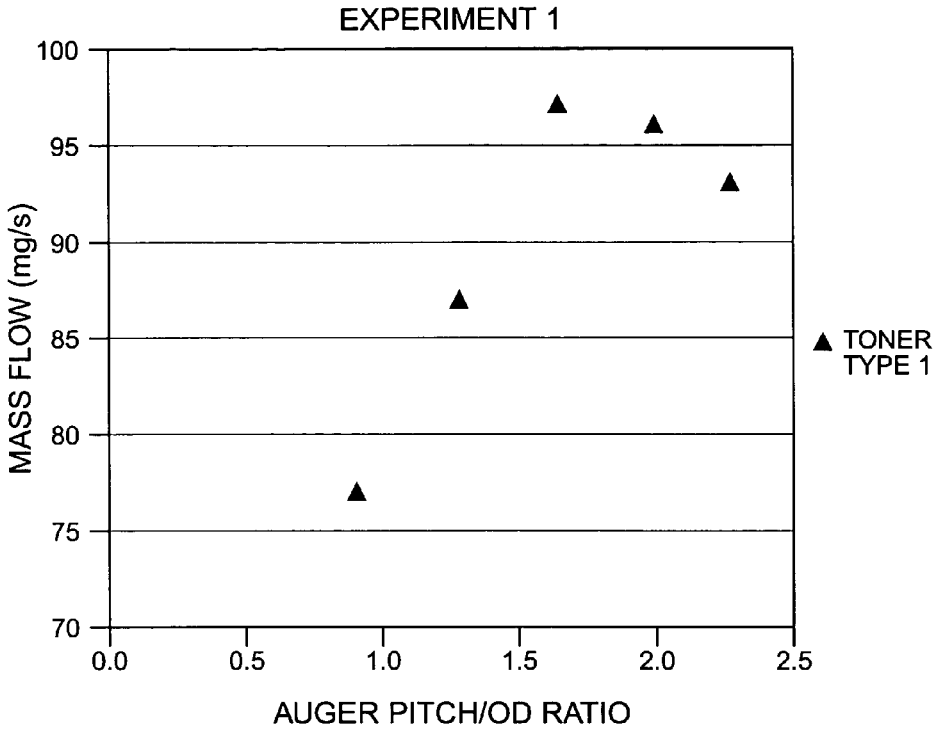
FIG. 7 is a data chart showing the optimal pitch to outer diameter ratio of a toner auger according to one embodiment of the present invention.

In Experiment 1, the toner throughput (in mg/s) for a toner labeled Toner Type 1 transported by augers having varying pitches was analyzed. The toner used in Experiment 1 was undeveloped, fresh toner. The results of Experiment 1 are shown in FIG. 7. The vertical axis of the chart shown in FIG. 7 represents the toner throughput or mass flow rate while the horizontal axis represents pitch P represented as a ratio of pitch P to auger outer diameter OD. This ratio is calculated by simply dividing the pitch P of an auger in a given unit of measure by the outer diameter OD of the auger in that same unit of measure. For instance, an auger with a 10.0 mm pitch and a 6.0 mm OD will have about the same pitch/OD ratio (approximately 1.7) as an auger with a 12.8 mm pitch and an OD of 7.7 mm. The results of Experiment 1 revealed that an optimal pitch to outer diameter ratio exists in the range between about 1.5 and about 2.5 with a peak toner throughput efficiency occurring at a ratio of about 1.7.

Experiment 2

Figure 8:
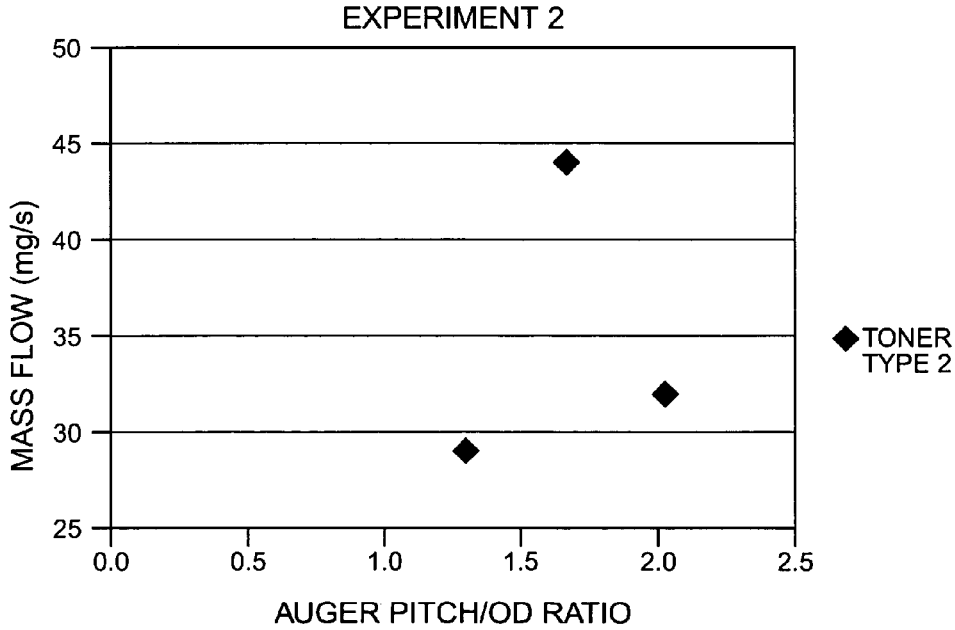
FIG. 8 is a data chart showing the optimal pitch to outer diameter ratio of a toner auger according to one embodiment of the present invention.

In Experiment 2, the same analysis as Experiment 1 was performed, but on a different toner, labeled Toner Type 2. The results of Experiment 2, shown in FIG. 8, revealed a somewhat narrower optimal range for the pitch to outer diameter ratio than was produced in Experiment 1. The peak toner throughput efficiency for Experiment 2 occurred at the same ratio of about 1.7. However, the throughput quickly falls off by about 25% for pitch to outside diameter ratios on either side of this peak efficiency. The narrowed optimal range may be explained by fact that cleaned toner was used in Experiment 2. Moving cleaned, residual toner is particularly difficult because various extra-particulate additives that improve fluidity are lost in the development process. The remaining components have worse powder-flow properties. Also, there may be paper fibers in the cleaned toner as well. Thus, toner transport capacity (throughput) for a wire auger moving waste toner can be significantly lower than the same wire auger moving unprocessed toner. Thus, the results of Experiment 2 show that the pitch of a waste toner auger 54 designed to transport waste toner is critical.

Experiment 3

Figure 9:
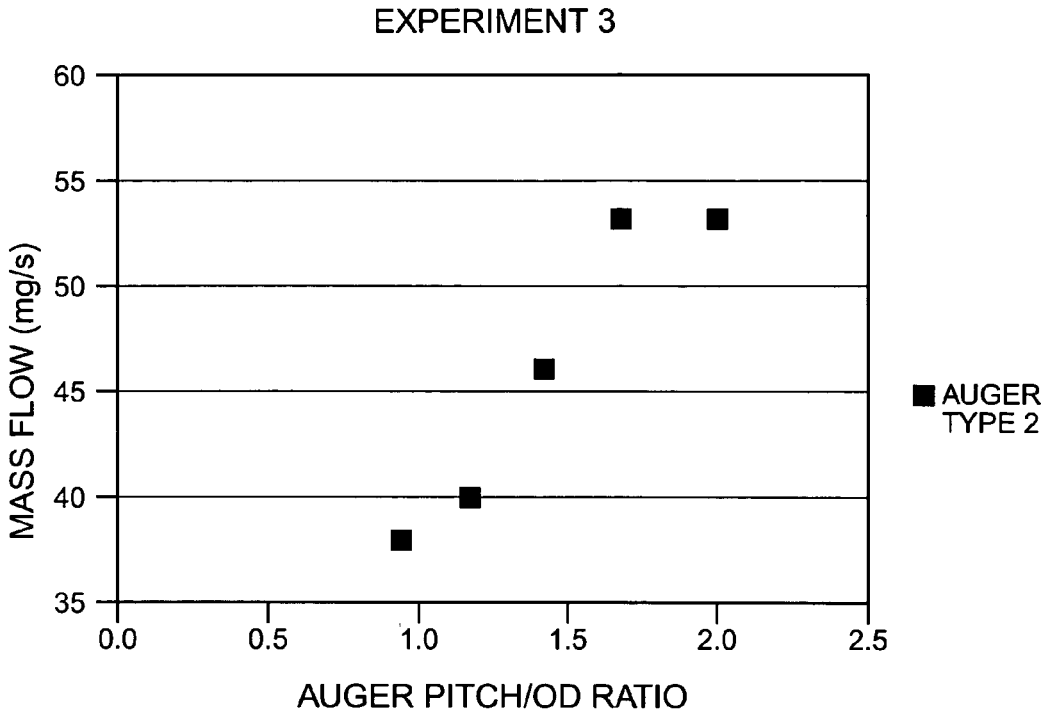
FIG. 9 is a data chart showing the optimal pitch to outer diameter ratio of a toner auger according to one embodiment of the present invention.
Figure 10:
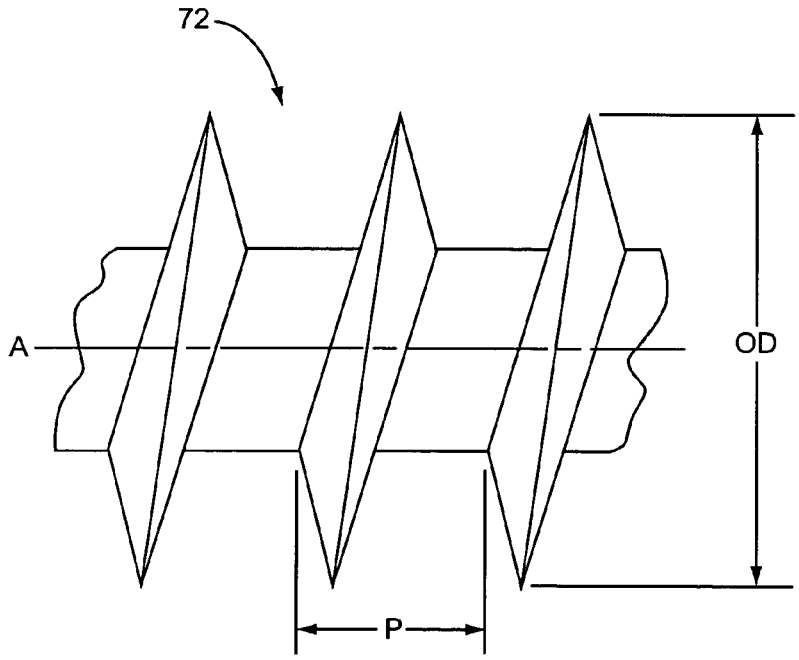
FIG. 10 is a partial side view of a screw-type auger according to one embodiment of the present invention.

In Experiment 3, the same analysis as Experiments 1 and 2 was performed, but on a different screw-type auger 72, labeled Auger Type 2. A representative example of an auger of this type is shown in FIG. 10. The outer diameter OD of the screw-type auger 72 was kept the same as the wire augers used in Experiments 1 and 2. Further, the same toner (Type 1) used in Experiment 1 was used in Experiment 3. The pitch P was varied as in Experiments 1 and 2. The results of Experiment 3, shown in FIG. 9, revealed results that are consistent with the other experiments. That is, an optimal pitch to outer diameter ratio exists in the range between about 1.5 and about 2.5. It is worth noting that the wire auger used in Experiment 1 produces larger throughput numbers than the helical screw used in Experiment 3. Thus, a wire auger 70 may advantageously provide more efficient toner transport than a screw type auger 72.

The results of the above experiments reveal that auger pitch P plays an important role in moving toner. Using these results, and given the size of the cleaner housing 62 disclosed above, it may be desirable to select an auger constructed of a helical coil having an outer diameter OD of between about 5.5 mm and 7.0 mm. In one embodiment, the waste toner auger 54 is selected to have an outer diameter of about 5.9 mm. The optimal pitch is determined from these OD values. In one embodiment, the pitch of the waste toner auger 54 is selected to be about 10.6 mm. Further, the optimized augers may also be selected based on a determinable helix angle θ. Using the equation for helix angle θ presented above, a corresponding helix angle may advantageously be selected to be between about 37° and about 45°. In one embodiment, the helix angle is selected to be about 42°.

The present invention may be carried out in other specific ways than those herein set forth without departing from the scope and essential characteristics of the invention. For instance, the embodiments described herein have been depicted in use as a waste toner auger 54. The experimental results show that undeveloped toner may also be efficiently transported using a helical coil 70 with the optimal characteristics disclosed herein. Further, the optimized auger may be incorporated in a variety of image forming devices including, for example, printers, fax machines, copiers, and multi-functional machines including vertical and horizontal architectures as are known in the art of electrophotographic reproduction. The present embodiments are, therefore, to be considered in all respects as illustrative and not restrictive, and all changes coming within the meaning and equivalency range of the appended claims are intended to be embraced therein.

What is claimed is:

1. A device for moving toner within an image forming apparatus comprising a helical member having a pitch to outer diameter ratio of between about 1.65 and 1.8.

2. The device of claim 1 wherein the helical member is a coil wire.

3. The device of claim 1 wherein the toner is waste toner.

4. The device of claim 1 wherein the toner is chemically produced toner.

5. The device of claim 1 wherein the toner is milled toner.

6. The device of claim 1 wherein the helical member is a helical wire member having an outer diameter of between about 5.5 and 7 millimeters.

7. The device of claim 1 wherein the helical member is a helical wire member having an outer diameter of less than about 7.5 millimeters.

8. The device of claim 1 wherein the helical member is a helical wire with a circular cross section shape.

9. The device of claim 1 wherein the helical member has an outer diameter of about 5.9 mm.

10. The device of claim 1 wherein the helical member has a pitch of about 10.6 mm.

11. A waste toner removal system for removing toner from a photoconductive member of a toner cartridge, the system comprising:

a cleaner member to remove the toner from the photoconductive member;

a cleaner housing; and a helical member having a helix angle of between about 37° and 45°.

12. The system of claim 11 wherein the helical member has a helix angle of about 42°.

13. The system of claim 11 wherein the helical member is a coil wire.

14. The system of claim 13 wherein the coil wire has an outer diameter of between about 5.5 and 7 millimeters.

15. A toner transport system for moving toner in an image forming apparatus, the system comprising:

a toner transport housing; and a helical member rotatably disposed within the housing, the helical member having a pitch to outer diameter ratio of between about 1.65 and 1.8.

16. The system of claim 15 wherein the helical member is a coil wire.

17. The system of claim 16 wherein the coil wire has an outer diameter of between about 5.5 and 7 millimeters.

18. The system of claim 15 wherein the toner is cleaned toner.

* * * * *